US008636305B2

(12) United States Patent
Gonzalez et al.

(10) Patent No.: US 8,636,305 B2
(45) Date of Patent: Jan. 28, 2014

(54) STREET PADDLE FOR SKATEBOARDS

(76) Inventors: Jesus Arturo Gonzalez, Miami Beach, FL (US); David Shawn Lemon, Miami Beach, FL (US)

( * ) Notice: Subject to any disclaimer, the term of this patent is extended or adjusted under 35 U.S.C. 154(b) by 399 days.

(21) Appl. No.: 12/612,636

(22) Filed: Nov. 4, 2009

(65) Prior Publication Data

US 2011/0101664 A1 May 5, 2011

(51) Int. Cl.
*B62M 29/02* (2006.01)

(52) U.S. Cl.
USPC ..... 280/809; 280/819; 280/219

(58) Field of Classification Search
USPC ..... 280/809, 819, 826, 821, 219; D21/775; D8/10; 135/77, 84, 86, 82
See application file for complete search history.

(56) References Cited

U.S. PATENT DOCUMENTS

| | | | | | |
|---|---|---|---|---|---|
| 3,436,088 | A * | 4/1969 | Kunselman | 280/842 |
| D262,646 | S * | 1/1982 | Mace | D21/775 |
| 5,125,687 | A * | 6/1992 | Hwang | 280/842 |
| 5,163,710 | A * | 11/1992 | Chirtel et al. | 280/809 |
| 5,236,222 | A * | 8/1993 | Fletcher | 280/809 |
| 5,312,135 | A * | 5/1994 | Karabees | 280/826 |
| 5,370,407 | A * | 12/1994 | Whalen | 280/809 |
| 5,388,673 | A * | 2/1995 | Rohner, III | 188/84 |
| 5,601,299 | A * | 2/1997 | Yun et al. | 280/87.042 |
| 5,653,468 | A * | 8/1997 | Ostapyk | 280/809 |
| 5,660,401 | A * | 8/1997 | Yi | 280/11.225 |
| D397,393 | S * | 8/1998 | Reed | D21/775 |
| 5,876,066 | A * | 3/1999 | Petkov | 280/819 |
| 6,715,794 | B2 * | 4/2004 | Frank | 280/826 |
| 6,961,967 | B1 * | 11/2005 | Brown | 5/81.1 R |
| 7,712,478 | B2 * | 5/2010 | Gibbons et al. | 135/73 |
| 8,408,224 | B2 * | 4/2013 | Ozuna et al. | 135/84 |
| 2009/0236816 | A1 * | 9/2009 | McBride | 280/219 |
| 2011/0011432 | A1 * | 1/2011 | Yakos et al. | 135/66 |
| 2011/0175338 | A1 * | 7/2011 | Senseman | 280/821 |
| 2012/0049502 | A1 * | 3/2012 | Ascunce | 280/821 |
| 2012/0139224 | A1 * | 6/2012 | Weir et al. | 280/821 |
| 2012/0326425 | A1 * | 12/2012 | Cubillo | 280/819 |

OTHER PUBLICATIONS

Kahuna Creations; Bamboo Big Stick page; Jun. 27, 2009.*
© 2009 Kahuna Creations, Enclosed you shall find the webpage showing a street paddle by Kahuna Creations www.kahunacreations.com.

* cited by examiner

*Primary Examiner* — Katy M Ebner
*Assistant Examiner* — Emma K Frick
(74) *Attorney, Agent, or Firm* — Ruben Alcoba, Esq.

(57) ABSTRACT

A street paddle for use with long board skateboards. The paddle has a shaft, a handle and an eight sided body. Two sides of the hexagonal body are hexagonal sides and the remaining sides are rectangular. The street paddle is used by wheeled skaters to propel a skateboard on a solid surface.

2 Claims, 3 Drawing Sheets

Fig. 2
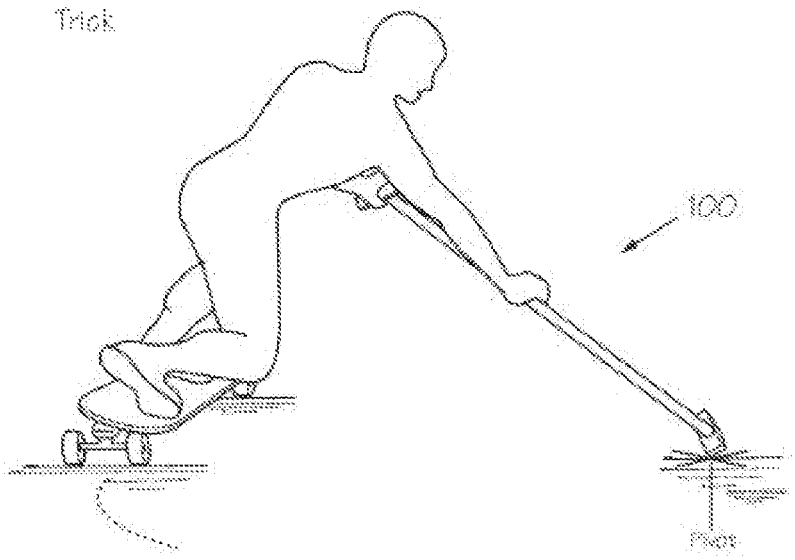
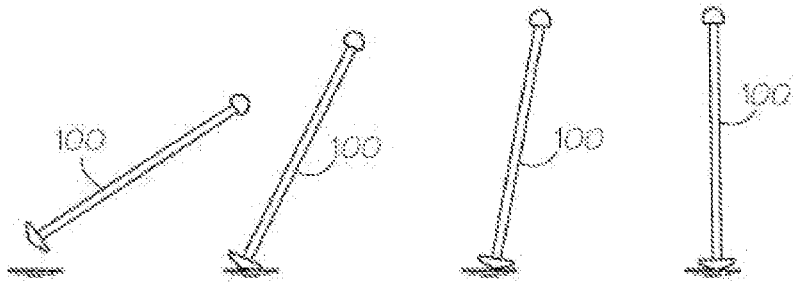
Fig. 3A

STREET PADDLE FOR SKATEBOARDS

BACKGROUND

The present invention is directed to a tools used to propel users of wheeled vehicles, more specifically skateboards. The tool is a street paddle.

The inventors of the present invention are avid skateboarders. They have mastered most skateboarding tricks and have advanced into long board skateboarding. One of the newest trends in long board skateboarding is the use of street paddles to propel skateboards. The inventors are aware of a street paddle sold by Kahuna Creations that is used to propel skateboards. The Kahuna street paddle uses circular structures at the end of the paddle to provide the traction to propel skateboards.

The inventors in their quest for speed realized that the Kahuna paddle did not take advantage of the principles of physics. They realized that the footprint created by the Kahuna paddle limited the force that could be generated with the paddle. They also realized that the greater the paddle's footprint the greater the force that would be created by the street paddle when propelling a skateboard.

The Kahuna paddle had another drawback. The drawback was that when the paddle was used by riders of skateboards as a stabilizing means, because the circular structures were made of rubber, that sometimes the friction created by the rubber limited the amount of tricks that the riders could perform on skateboards. They therefore designed a structure that would have two lateral sides made of a material that would have a smaller coefficient of friction than rubber, thereby allowing users of the paddles to use the paddles as a stabilizing means without robbing them of the speed needed to perform some tricks.

The present invention had one advantage that was not planned by the present inventors, the ability to use the paddle as a wedge when using the paddle to stop the skateboard.

For the foregoing reasons, there is a need for a street paddle that will allow users of skateboards to propel skateboards faster, that will allow users of skateboards to perform more tricks, and that will allow users of skateboards to stop faster.

SUMMARY

The present invention is directed to a street paddle that will allow users of skateboards to propel skateboards faster, that will allow users of skateboards to perform more tricks, and that will allow users of skateboards to break faster.

A street paddle for use with skateboards. The paddle has a shaft, a handle and an eight sided body. The eight sided body is comprised of two hexagonal sides that are parallel to each other, and each hexagonal side has a top, a bottom, a left, a right, a left angular and a right angular side, each top hexagonal side is perpendicular to the shaft, and six rectangular bodies. The rectangular bodies are a top rectangular body attached to each top side of the hexagonal sides, a bottom rectangular body attached to each bottom side of the hexagonal sides, a left angular rectangular body attached to each left angular side of the hexagonal sides, a right angular rectangular body attached to each right angular side of the hexagonal sides, a left rectangular body attached to each left side of the hexagonal sides, and a right rectangular body attached to each right side of the hexagonal sides. The street paddle might also have a first and a second pad, the first pad is fixedly attached to the left rectangular side of the eight sided body, and the second pad is fixedly attached to the right rectangular side of the eight sided body.

An object of the present invention is to provide a street paddle that will allow a user of a skateboard to propel a skateboard faster.

Another object of the present invention is to allow a user of a skateboard to perform a greater number of tricks when riding a skateboard.

Yet, another object of the present invention is to allow a user of a skateboard to break faster.

DRAWINGS

These and other features, aspects, and advantages of the present invention will become better understood with regard to the following description, appended claims, and drawings where:

FIG. 2 is a drawing showing a user of a skateboard using the present invention to perform tricks;

FIG. 3A show how the present invention is propelled;

DESCRIPTION

Figure 1B:
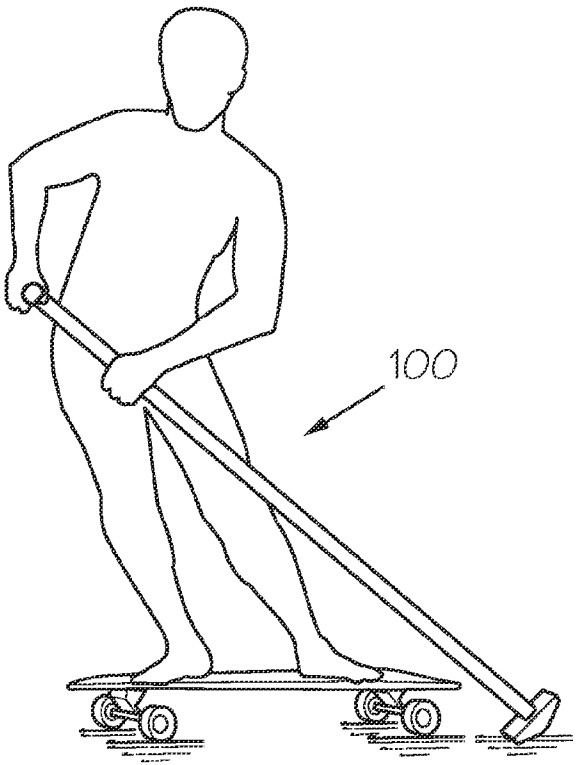
FIG. 1B is a drawing showing a user of a skateboard using the present invention to break the movement of a skateboard.
Figure 1A:
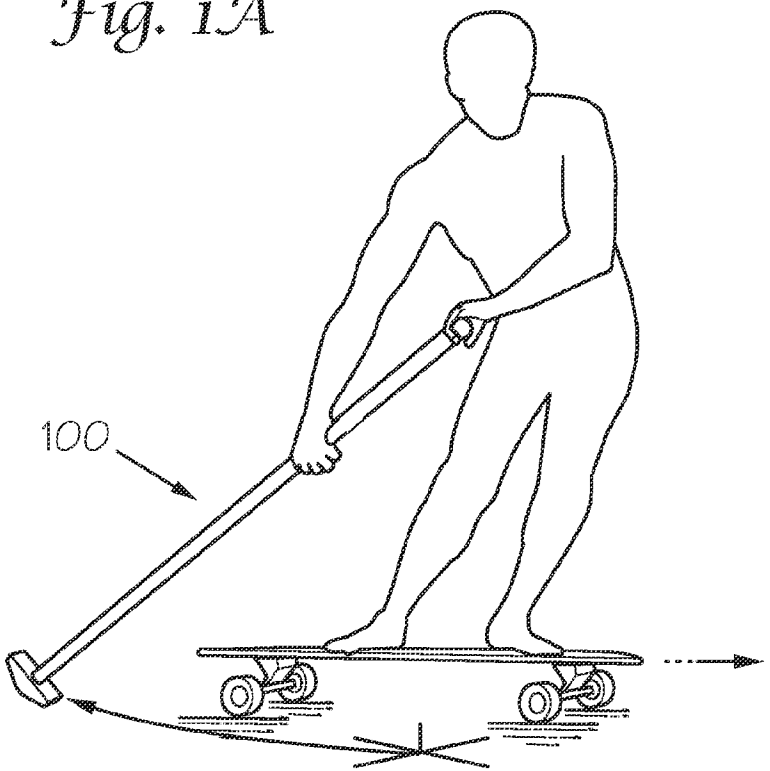
FIG. 1A is a drawing showing a user of a skateboard using the present invention to propel the a skateboard forward.
Figure 4:
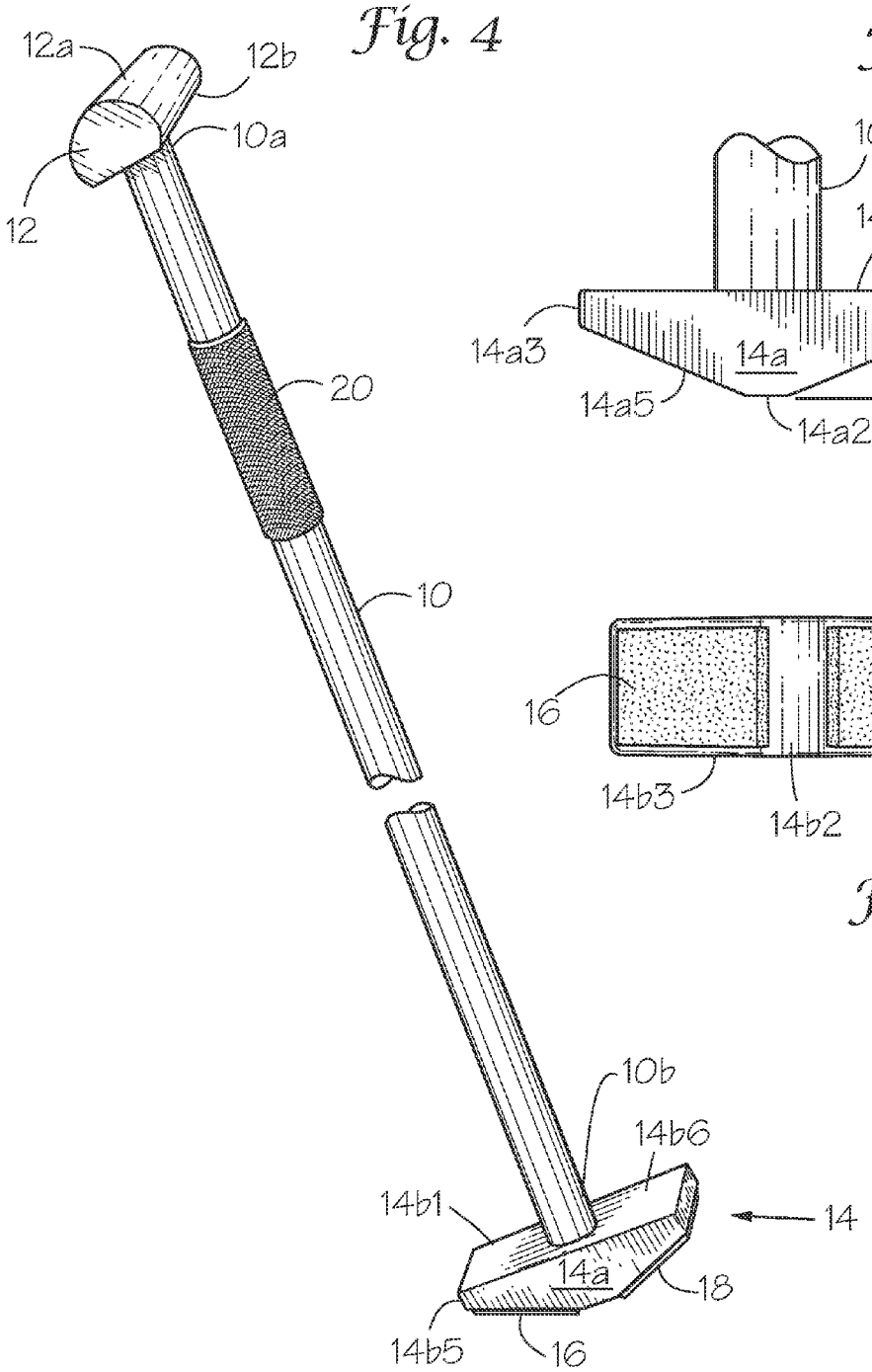
FIG. 4 shows a perspective of the present invention.
Figure 5:
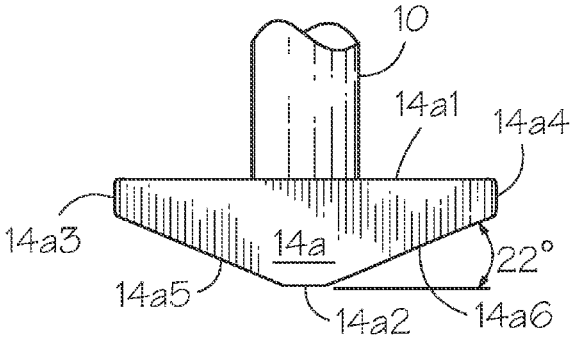
FIG. 5 shows a side view of the eight sided body and the shaft of the present invention.
Figure 6:
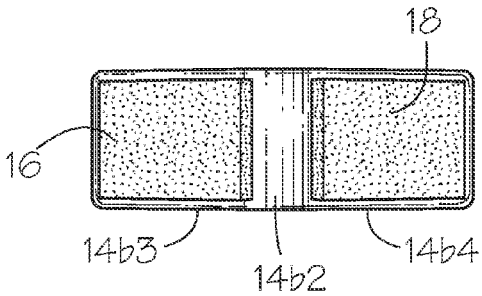
FIG. 6 shows a bottom view of the bottom rectangular side of the present invention's eight sided body.

As seen in FIG. 4, a street paddle 100 for use with long board skateboards, comprising a shaft 10, a handle 12 attached to one side of the shaft 10, and an eight sided body 14 attached to the other side of the shaft 10.

The shaft having a first 10*a* and a second end 10*b*, and the shaft 10 being between at least 3.5 and no more than 5.5 feet in length and having a diameter of at least 1.25 inches.

The handle 12 is fixedly attached to the first end of the shaft 10*a*.

The eight sided body 14 is comprised of two hexagonal sides 14*a* that are parallel to each other, each hexagonal side has a top 14*a*1, a bottom 14*a*2, a left 14*a*3, a right 14*a*4, a left angular 14*a*5 and a right angular 14*a*6 side, each top hexagonal side 14*a*1 is perpendicular to the shaft 10, and six rectangular bodies. The six rectangular bodies are a top rectangular body 14*b*1 attached to each top side of the hexagonal sides 14*a*1, a bottom rectangular body 14*b*2 attached to each bottom side of the hexagonal sides 14*a*2, a left angular rectangular body 14*b*3 attached to each left angular side of the hexagonal sides 14*a*5, a right angular rectangular body 14*b*4 attached to each right angular side of the hexagonal sides 14*a*6, a left rectangular body 14*b*5 attached to each left side of the hexagonal sides 14*a*3, and a right rectangular body 14*b*6 attached to each right side of the hexagonal sides 14*a*4. The top rectangular body 14*b*1 is attached to the second end of the shaft 10*b* so that it is centered around the second end of the shaft 10*b*.

In a preferred embodiment of the present invention, the top rectangular body 14*b*1 has a length of five inches and a width of one and a half inches, the bottom rectangular body 14*b*2 has a length of five eighths of an inch and a width of one and a half inches, the left 14*b*5 and right rectangular bodies 14*b*6 have a length of five eighths of an inch and a width of one and a half inches, and the left 14*b*3 and right angular rectangular 14*b*4 sides would have a length of two and a quarter inches and a width of one and a half inches. The left 14*a*5 and right angular sides 14*a*6 of the hexagonal sides 14*a* rise from the bottom hexagonal side 14*a*2 at an angle of twenty two and a half degree. The measurements of the present invention can be adjusted accordingly so long as the rise is between twenty and thirty five degree.

The present invention further comprises of a first 16 and a second pad 18, the first pad 16*a* is fixedly attached to each left angular rectangular side 14*b*3 of the eight sided body 14, and the second pad 18 is fixedly attached to each right angular rectangular side 14*b*4 of the eight sided body 14. The first 16 and second pads 18 are made of at least 0.125 of inch thick rubber.

In an embodiment of the present invention the handle 12 is rod shaped and has a length of at least 4 inches, the handle 12 runs perpendicular to the shaft 10 and the handle 12 is centered on the first end of the shaft 10*a*, the handle 10 has a top rounded 12*a* section and a flat bottom section 12*b* that run along the length of the handle 10, the flat bottom section 12*b* is the section attached to the first end of the shaft 10*a*. The length of the handle 12 runs perpendicular to the top side of each hexagonal side 14*a*1 of the eight sided body 14.

In another embodiment of the present invention, the street paddle 100 comprises of a grip section 20, the grip section 20 is fixedly attached around the circumference of the shaft 10 at a position that is at least 1.5 feet from the first end of the shaft 10*a*.

In yet another embodiment of the present invention, the shaft 10, the handle 12 and eight sided body 12 are made of wood or of a similar material.

In still another embodiment of the present invention, the shaft 10 is made of bamboo and the handle 12 and eight sided body 14 might be made of wood or of a similar material.

In an embodiment of the present invention, the eight sided body 14 of the street paddle 100 is solid.

The present invention is used as follows to propel a skateboard: 1. Providing the paddle 100; 2. Providing a skateboard; 3. Providing a user; 4. Having the user get on the skateboard and hold the paddle 100; 5. Then, having the user place the bottom rectangular side 14*b*2 of the eight sided body 14 against a surface below the skateboard; and 6. Then, having the user stroke the paddle 100 toward the rear of the skateboard. To stop the skateboard, the user would place either the first 16 or second pad 18 flush with the surface ahead of the skateboard. To perform tricks on the skateboard, the user would place one of the hexagonal sides 14*a* of the eight sided body 14 on the surface while performing the tricks.

An advantage of the present invention is that it provides a street paddle that allows users of skateboards to propel skateboards faster.

Another advantage of the present invention is that it allows users of skateboards to perform greater number of tricks when riding a skateboards.

Yet, another advantage of the present invention is that it allows users of skateboards to break faster.

Although the present invention has been described in considerable detail with reference to certain preferred versions thereof, other versions are possible. Therefore the spirit and the scope of the claims should not be limited to the description of the preferred versions contained herein.

What is claimed is:

1. A street paddle for use with long board skateboards, comprising:

a shaft, the shaft having a substantially cylindrical longitudinal axis and a first and a second end, and the substantially cylindrical longitudinal axis of the shaft being between at least 3.5 and no more than 5.5 feet in length and having a diameter of at least 1.25 inches;

a handle member, sized and configured to fit comfortably in the palm of a user's hand, having a substantially cylindrical longitudinal axis fixedly attached to the first end of the shaft at a point approximately midway about the longitudinal axis thereof, configured such that the longitudinal axis of the handle member is in a perpendicular coplanar alignment with the longitudinal axis of the shaft;

an eight sided body fixedly attached to the second end of the longitudinal axis of the shaft, such that the eight sided body is coplanar and perpendicular to the second end of the shaft and the eight sided body is non-coplanar and perpendicular to the longitudinal axis of the handle member, configured such that the longitudinal axis of the handle member and the eight sided body resemble a plus sign (+) when viewed from above with the shaft perpendicular to a ground surface, wherein the eight sided body includes two hexagonal side members, which are parallel, and six rectangular side bodies, and wherein each hexagonal side member has a top, a bottom, a left, a right, a left an angular, and a right angular side, wherein six rectangular bodies are a top rectangular body attached to each top side of the hexagonal sides, a bottom rectangular body located opposite and parallel to the top rectangular body attached to each bottom side of the hexagonal sides, a left angular rectangular body attached to each left angular side of the hexagonal sides, a rectangular body attached to each right side of the hexagonal sides, and the top rectangular body is attached to the second end of the shaft so that it is centered around the rectangular body is attached to the second end of the shaft so that it is centered around the second end of the shaft; and a first and a second high coefficient of friction pad, the first pad is fixedly attached to the right angular rectangular body and the second pad is fixedly attached to the left angular rectangular body, and there is no high coefficient of friction pad attached to the bottom rectangular body.

2. A method of using the street paddle of claim 1 for propelling a skateboard comprising the steps of:

providing the paddle;

providing a skateboard;

providing a user;

having the user mount the skateboard while holding the paddle;

having the user place either the first or the second high coefficient of friction pad in contact with a around surface below the skateboard while the user is mounted on the skateboard; and then having the user exert a force upon the paddle sufficient to propel the user forward or backward while the user is mounted on the skateboard.

* * * * *